US006722323B2

(12) United States Patent
Kawamoto

(10) Patent No.: US 6,722,323 B2
(45) Date of Patent: Apr. 20, 2004

(54) V-TYPE ENGINE FOR VEHICLE

(75) Inventor: Yuichi Kawamoto, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/419,124

(22) Filed: Apr. 21, 2003

(65) Prior Publication Data

US 2003/0200940 A1 Oct. 30, 2003

(30) Foreign Application Priority Data

Apr. 24, 2002 (JP) ..... 2002-121817

(51) Int. Cl.[7] ..... F01L 1/02; F02B 67/06

(52) U.S. Cl. ..... 123/54.4; 123/90.31; 123/90.27

(58) Field of Search ..... 123/54.4, 90.31, 123/90.27, 195 R; 474/144; 180/233

(56) References Cited

U.S. PATENT DOCUMENTS 5,014,655 A * 5/1991 Ampferer ..... 123/90.31
5,231,961 A * 8/1993 Shimada et al. ..... 123/90.27
6,269,899 B1 * 8/2001 Izumi ..... 180/233
6,378,478 B1 * 4/2002 Lagies ..... 123/90.31
6,637,398 B2 * 10/2003 Suzuki et al. ..... 123/195 R
6,672,982 B2 * 1/2004 Ikusue et al. ..... 474/144

FOREIGN PATENT DOCUMENTS

JP B2 63-11174 3/1988

* cited by examiner

*Primary Examiner*—Marguerite McMahon
(74) *Attorney, Agent, or Firm*—Oliff & Berridge, PLC

(57) ABSTRACT

A V-type engine for vehicle of the present invention includes: a crank shaft; a cam driving intermediate shaft arranged above the crank shaft; a power transmitting mechanism interconnecting the cam driving intermediate shaft and the crank shaft; cam driving chain mechanisms respectively interconnecting the cam driving intermediate shaft and each of front and rear cam shafts; a change gear input shaft; a change gear output shaft arranged in a back part in a mission chamber; and a tensioner for the cam driving chain mechanism for the rear cam shaft. The change gear input shaft and the tensioner are positioned within a range between a line connecting an axis of the change gear output shaft and an axis of the crank shaft and the rear cylinder unit.

6 Claims, 5 Drawing Sheets

V-TYPE ENGINE FOR VEHICLE

BACKGROUND OF THE INVENTION

1. Field of the Invention

The present invention relates to a V-type engine for vehicle to be loaded on an all-terrain four-wheel vehicle or a motorcycle and more particularly to a V-type engine comprising a front cylinder unit in a forward slanting position, a rear cylinder unit in a backward slanting position, and a mission chamber formed integrally with a crank case on the back part thereof, the front and rear cylinder units including cylinder heads respectively having a valve driving cam shaft.

2. Description of the Related Art

In this kind of V-type engine with overhead cam shaft for vehicle, a chain mechanism may be used as a cam shaft driving system. Each of cam shaft driving chain mechanisms for a front cylinder unit and a rear cylinder unit is structured so as to respectively wind a cam chain between a sprocket fixed to each cam shaft and a sprocket installed on a crank shaft. The power is directly transmitted to the cam shaft from the crank shaft via the cam shaft driving chain mechanism.

The cam driving chain mechanisms for the front and rear cylinder units are respectively provided with a tensioner. Tension is given to each of the cam chains, thus the cam chains are prevented from looseness, and a good power transmitting condition is kept, and generation of noise is reduced.

Such a cam chain tensioner is arranged on the loosening side of the cam chain and, in accordance with the rotational direction of the crank shaft, for the front cylinder unit, the tensioner is arranged on the rear upper side of the cam chain and for the rear cylinder unit, the tensioner is arranged on the rear under side of the cam chain.

However, in a V-type engine for vehicle in which a mission chamber is formed integrally with a crank case on the back part thereof, the tensioner of the rear cylinder unit is attached so as to be projected backward and downward from the rear cylinder unit toward the mission chamber. Therefore, the space of the mission chamber is restricted forward and upward, and the mission chamber must be formed long in the back-and-forth direction so as to store the mission. Accordingly, the size of the crank case in the back-and-forth direction must be made larger.

Further, the space between the rear cylinder unit and the mission chamber is narrow, so that the removal and adjustment operation for the tensioner for the rear cylinder unit requires a great deal of time. Incidentally, as a document of conventional art, Japanese Patent Publication 63-11174 may be cited.

SUMMARY OF THE INVENTION

The present invention was developed in consideration of the aforementioned problems and is intended to devise a power transmitting mechanism from a crank shaft to a cam shaft and arrangement of change gear shafts in a mission chamber, thereby reduce a size of a V-type engine for vehicle in a back-and-forth direction, and facilitate attaching and adjusting operations for the tensioner of a cam chain for a rear cylinder unit.

To solve the aforementioned problems, a V-type engine for vehicle according to the present invention comprises a front cylinder unit disposed in a forward slanting position, said front cylinder unit including a front cylinder, a front cylinder head for said front cylinder, and a front cam shaft arranged on said front cylinder head; a rear cylinder unit disposed in a backward slanting position, said rear cylinder unit including a rear cylinder, a rear cylinder head for said rear cylinder, and a rear cam shaft arranged on said rear cylinder head; a crank case with which a mission chamber is integrally formed at a back part of said crank case; a crank shaft rotatably supported in said crank case; a cam driving intermediate shaft arranged above said crank shaft; a power transmitting mechanism interconnecting said cam driving intermediate shaft and said crank shaft; cam driving chain mechanisms respectively interconnecting said cam driving intermediate shaft and each of said front and rear cam shafts; a change gear input shaft to which a power from said crank shaft is input; a change gear output shaft from which a power is output to an axle of said vehicle, said change gear output shaft being arranged in a back part in said mission chamber; and a tensioner for said cam driving chain mechanism for said rear cam shaft; wherein said change gear input shaft and said tensioner are positioned within a range between a line connecting a shaft axis of said change gear output shaft and a shaft axis of said crank shaft and said rear cylinder unit.

By doing this, a space backward and downward the rear cylinder unit is widely reserved, and the space can be effectively used for an arrangement of the tensioner of the cam driving chain mechanism for the rear cylinder unit, and an arrangement position of the change gear input shaft can be easily changed upward, and the distance between the crank shaft and the change gear output shaft can be shortened, thus a size of the crank case in the back-and-forth direction can be reduced.

Further, in the wide space existing between the line connecting the axis of the crank shaft and the axis of the change gear output shaft and the rear cylinder unit, the tensioner for the cam driving chain mechanism for the rear cylinder unit is arranged, so that the attaching and adjusting operations for the tensioner can be performed easily.

Preferably, the V-type engine for vehicle further comprises a backward idle shaft arranged under said line connecting said shaft axis of said change gear output shaft and said shaft axis of said crank shaft.

By doing this, in correspondence to arrangement of the change gear input shaft upward, the reduction in the size of the crank case in the back-and-forth direction can be realized.

Preferably, the V-type engine for vehicle further comprises a carburetor or a fuel jet device arranged above a V bank formed between said front cylinder unit and said rear cylinder unit.

By doing this, the periphery of the engine can also be made compact and is suited to an engine for vehicle.

Preferably, a center line of a V bank formed between said front cylinder unit and said rear cylinder unit is put into a slightly forward slanting position.

Preferably, said tensioner for said cam driving chain mechanism for said rear cam shaft is disposed on a rear wall of said rear cylinder.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Vehicle to be Loaded with an Engine

Figure 1:
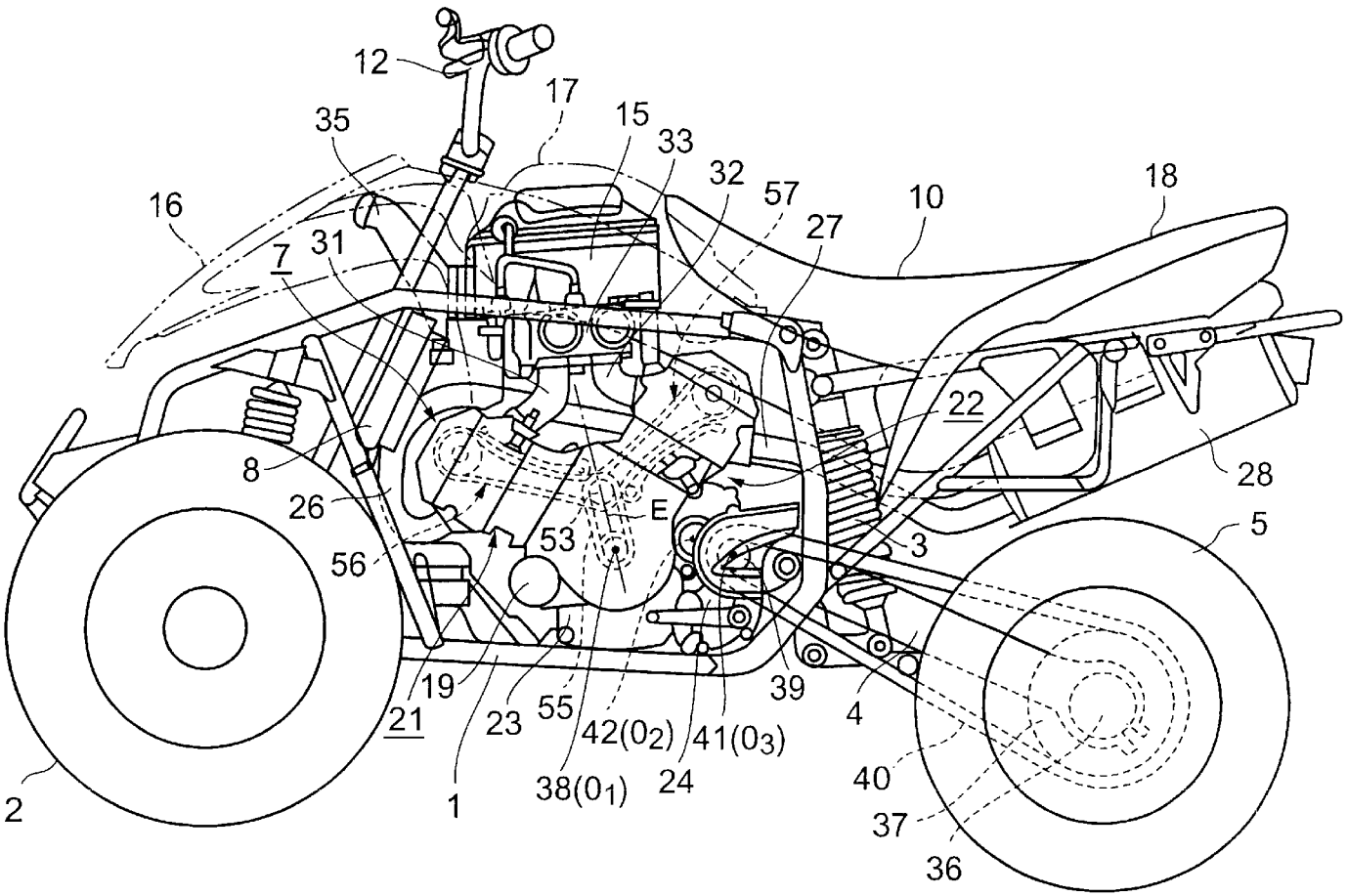
FIG. 1 is a left side view of a straddle type four-wheel all-terrain vehicle loading a V-type engine as an embodiment of the present invention.

As shown in FIG. 1, a straddle type four-wheel all-terrain vehicle is loaded with a 2-cylinder V type engine 7 of an overhead cam shaft system as an embodiment of the present invention. The all-terrain vehicle has a pair of front wheels 2 in front of a body frame 1 and a pair of rear wheels 5 via a swing arm 4 behind the body frame 1 and the swing arm 4 is elastically supported by a shock absorber 3. In the body frame 1, the engine 7 and a radiator 8 are attached, and above the body frame 1, a straddle type sheet 10 and a bar-shaped handle 12 are installed. An air cleaner box 15 is arranged between the handle 12 and the sheet 10. Further, above the front wheels 2 and the rear wheels 5, a front fender 16 and a rear fender 18 are respectively installed and above the air cleaner box 15, a decorative cover 17 is arranged.

The engine 7 has a front cylinder unit 21 in a forward slanting position, a rear cylinder unit 22 in a backward slanting position, and a crank case 23 shared by both front and rear cylinder units 21 and 22, and a mission chamber (mission case portion) 24 is formed integrally with the crank case 23 on a back part thereof. The engine 7 is loaded in the frame 1 such that a center line E of a V bank formed between the front and rear cylinder units 21 and 22 is put into a slightly forward slanting position so as to reserve a space rearward and downward rear cylinder unit 21 widely. At a front end of the crank case 23, a start motor 19 is arranged under the front cylinder unit 21.

An exhaust pipe 26 connected to a front surface of the front cylinder unit 21 is curved on a right side and extended backward and an exhaust pipe 27 connected to a rear surface of the rear cylinder unit 22 is extended backward almost as it is. Both of the exhaust pipes 26 and 27 are connected to one exhaust muffler 28 arranged a rear end of the vehicle.

A suction pipe 31 connected to a rear surface of the front cylinder unit 21 and a suction pipe 32 connected to the front surface of the rear cylinder unit 22 are extended upward in the V bank and connected to a lower exit of a carburetor 33 arranged above the V bank. An upper entrance of the carburetor 33 is connected to the air cleaner box 15, and to a front of the air cleaner box 15, a suction duct 35 is connected. The suction duct 35 is extended forward in the fender 16 and takes in an inlet air of the engine via the air intake thereof positioned in the fender 16.

At a rear end in the mission chamber 24, a change gear output shaft (shaft axis O3) 41 is arranged almost at the same height as that of a crank shaft (shaft axis O1) 38 rotatably supported in the crankcase 23. Between an output sprocket 39 fixed to a left end of the change gear output shaft 41 and a sprocket 37 of a rear axle 36, a rear wheel driving chain 40 is wound, and the rear wheels 5 is rotated by the rear wheel driving chain 40.

Engine

Figure 2:
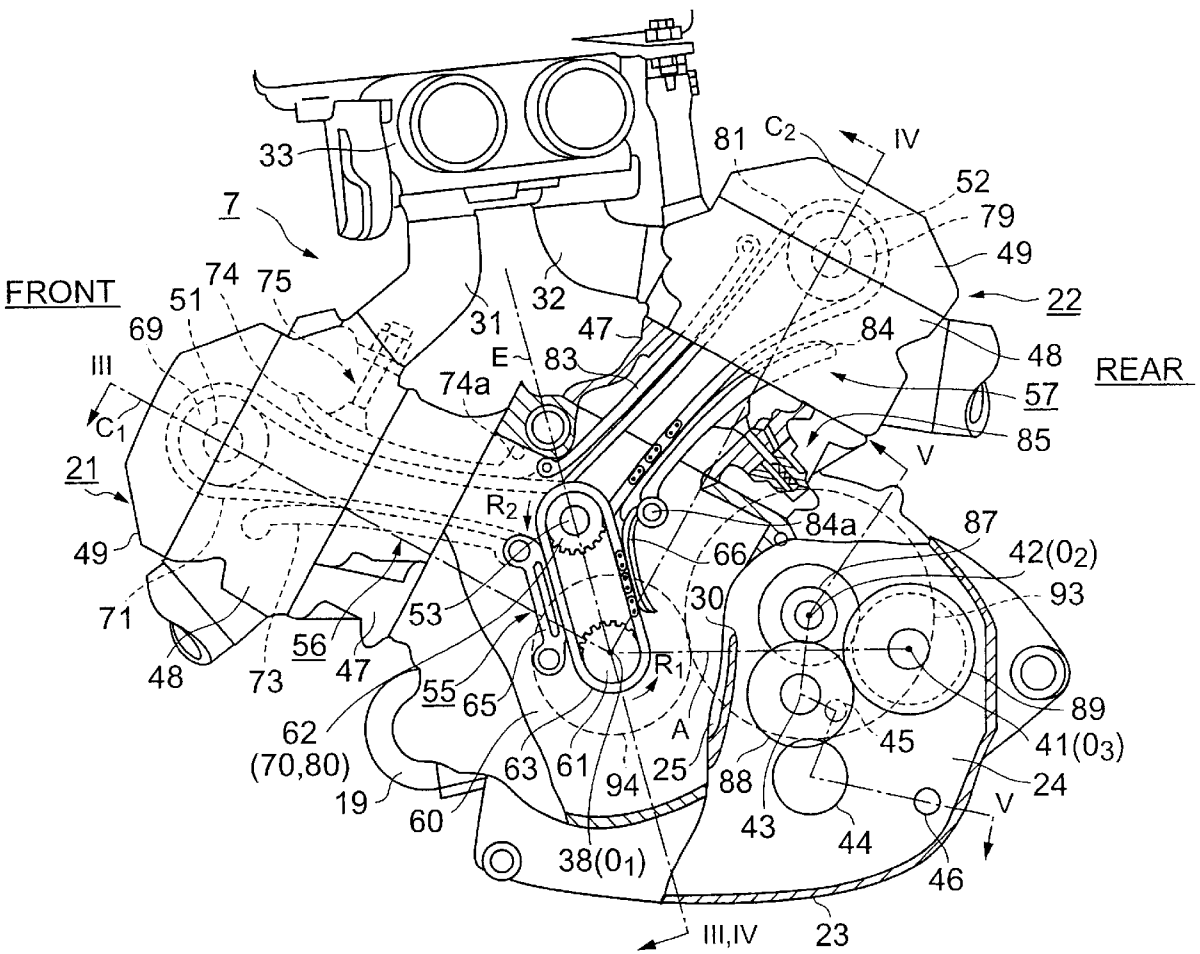
FIG. 2 is an enlarged left side view showing the V-type engine shown in FIG. 1 with partial cutout.

As shown in FIG. 2, in the engine 7, the front and rear cylinder units 21 and 22 are respectively composed of a cylinder 47, a cylinder head 48, and a head cover 49 which are sequentially fixed to the crank case 23 and have cam shafts 51 and 52 for driving the valves on the cylinder heads 48. Above the crank shaft 38 and on the center line E of the V bank, a cam driving intermediate shaft 53 is arranged and the cam driving intermediate shaft 53 is interconnected to the crank shaft 38 via a cam driving intermediate chain mechanism 55. The cam shafts 51 and 52 of the front and rear cylinder units 21 and 22 are respectively interconnected to the cam driving intermediate shaft 53 at a speed reduction ratio of 1:2 via cam driving chain mechanisms 56 and 57.

The cam driving intermediate chain mechanism 55 is stored in a generator chamber 60 (FIG. 3) formed at a left end of the crank case 23 and composed of a sprocket 61 formed at a left end of the crank shaft 38, a sprocket 62 fixed at the left end of the cam driving intermediate shaft 53, and a cam driving intermediate chain 63 wound between the sprockets 61 and 62. The power is transmitted from the crank shaft 38 to the cam driving intermediate shaft 53 at a speed reduction ratio of 1:1. On a tension side (on the front side) of the intermediate chain 63, a chain guide 65 is arranged, and on the looseness side, a guide shoe 66 is arranged, and a tensioner (not shown in the drawing) is installed on the guide shoe 66.

The cam driving chain mechanism 56 for the front cylinder unit 21 is composed of a sprocket 69 fixed to the cam shaft 51 of the front cylinder unit 21, an intermediate sprocket 62, which is overlaid on the intermediate sprocket 62, thereby cannot be seen in the drawing, fixed to the cam driving intermediate shaft 53 and a cam chain 71 for the front cylinder unit 21 which is wound between the sprockets 69 and 70. The power is transmitted from the cam driving intermediate shaft 53 to the cam shaft 51 of the front cylinder unit 21 at a speed reduction ratio of 1:2. The cam driving intermediate shaft 53 rotates in the direction of the arrow R2, thus the front lower side of the cam chain 71 becomes a tension side and the rear upper side becomes a loose side. On the tension side of the cam chain 71, a chain guide 73 is arranged, and on the loose side of the same, a guide shoe 74 capable of rotating around a fulcrum 74*a* and an automatic tensioner 75 for pressing the guide shoe 74 on the chain side are arranged. The automatic tensioner 75 is, for example, a ratchet type automatic tensioner using a rack, ratchet pawls, and a spring. The automatic tensioner is inserted into a rear wall of the cylinder head 48 of the front cylinder unit 21 from the rear upper side and fixed by a bolt.

The cam driving chain mechanism 57 for the rear cylinder unit 22 is composed of a sprocket 79 for the cam fixed to the cam shaft 52 of the rear cylinder unit 22, an intermediate sprocket 80, which is overlaid on the intermediate sprocket 62 in the drawing, thereby cannot be seen, fixed to the cam driving intermediate shaft 53, and a cam chain 81 for the rear cylinder unit 22 wound between the sprockets 79 and 80. The power is transmitted from the cam driving intermediate shaft 53 to the cam shaft 52 of the rear cylinder unit 22 at a speed reduction ratio of 1:2.

A front upper side of the cam chain 81 for the rear cylinder unit 22 is a tension side and the rear lower side is a loose side. On the tension side of the cam chain 81, a chain guide 83 is arranged, and on the loose side, a guide shoe 84 capable of rotating around a fulcrum 84*a* and an automatic tensioner 85 for pressing the guide shoe 84 on the chain side are arranged. The automatic tensioner 85 for the rear cylinder unit 22 is also a ratchet type automatic tensioner using a rack, ratchet pawls, and a spring. The automatic tensioner 85 is inserted into the rear wall of the cylinder 47 of the rear cylinder unit 22 from the rear lower side and fixed by a bolt.

The cam driving chain mechanism 57 for the rear cylinder unit 22 transmits the power to the cam shaft 52 of the rear cylinder unit 22 using the cam driving intermediate shaft 53 arranged above the crank shaft 38. Therefore, the cam chain 81 for the rear cylinder unit 22 is put into a state that it is biased to the forward upper position in the rear cylinder unit 22. Thus, a space backward and downward the cam chain 81 for the rear cylinder unit 22 is reserved wide, and the automatic tensioner 85 for the rear cylinder unit 22 is arranged in the space.

In the mission chamber 24 formed in the back part of the crank case 23, a partition wall 30 is formed between the mission chamber 24 and the crank chamber 25 in the front part, and oil is collected in the lower part, thus the mission chamber plays a role as an oil chamber in the dry sump engine.

In the mission chamber 24, together with the change gear output shaft 41, a change gear input shaft 42, a backward idle shaft 43, a chain drum 44, a shift rod 45, and a change shaft 46 are arranged. The change gear input shaft 42 is positioned between the crank shaft 38 and the change gear output shaft 41 in the back-and-forth direction and arranged above a line A connecting the crank shaft axis O1 and the change gear output shaft axis O3. The backward idle shaft 43 is positioned between the crank shaft 38 and the change gear output shaft 41 in the back-and-forth direction and arranged under the line A connecting the crank shaft axis O1 and the change gear output shaft axis O3. The change drum 44 is arranged under the backward idle shaft 43. The change shaft 46 connected to a change pedal of the vehicle is arranged at a rear lower end of the mission chamber 24.

Figure 3:
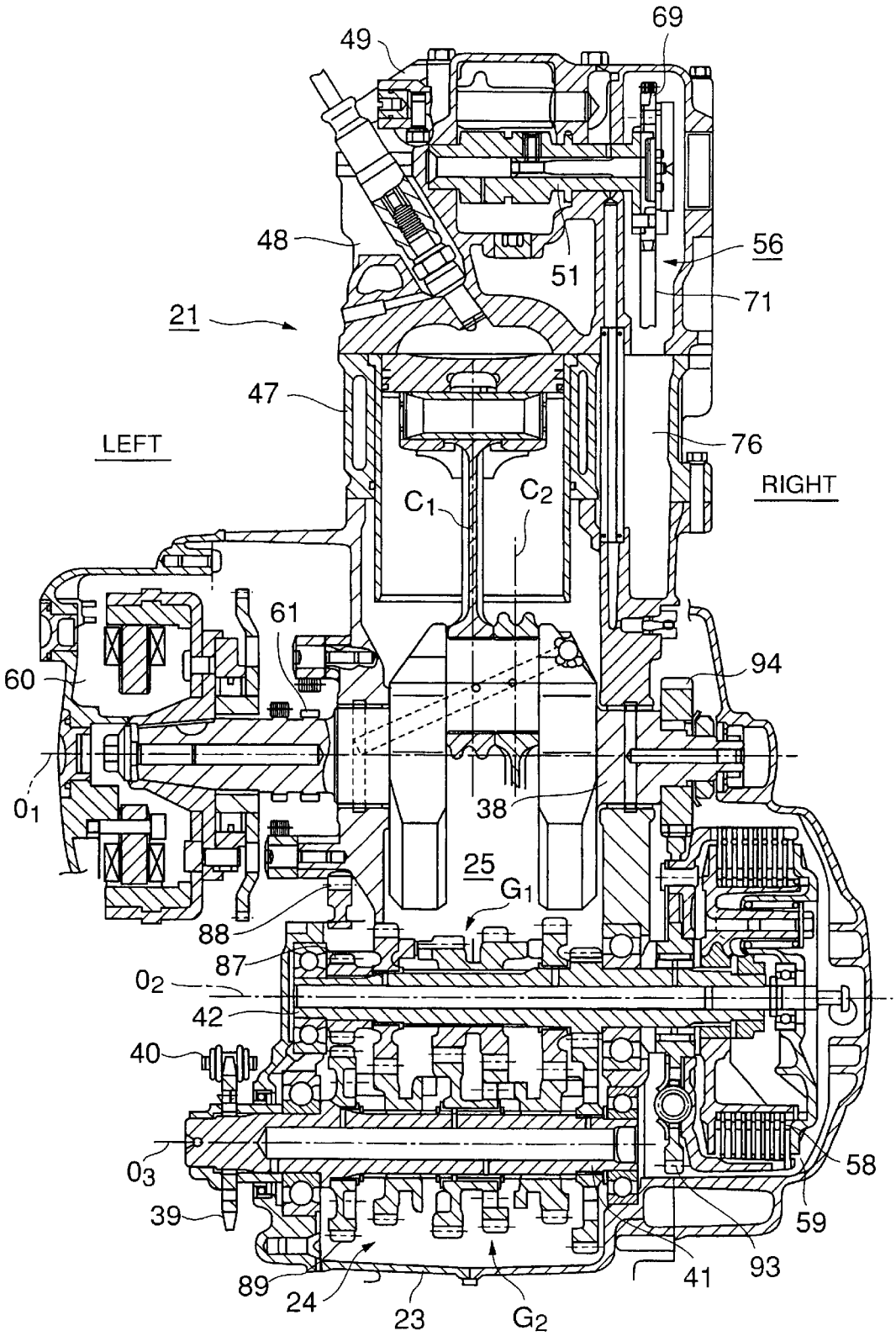
FIG. 3 is a development elevation of the section III—III shown in FIG. 2.

FIG. 3 is a sectional view of the section III—III shown in FIG. 2, showing the inside of the front cylinder unit 21 and the mission chamber 24. In FIG. 3, a cylinder center line C1 of the front cylinder unit 21 is shifted from a cylinder center line C2 of the rear cylinder unit 22 to the left. On the right end side of the front cylinder unit 21, the cam driving chain mechanism 56 for the front cylinder unit 21 is arranged. Namely, a chain tunnel 76 is formed in a right end wall of the front cylinder unit 21. A cam sprocket 69 is installed at a right end of the cam shaft 51 for the front cylinder unit 21. The cam chain 71 for the front cylinder unit 21 is led into a clutch chamber 59 via the chain tunnel 76 for the front cylinder unit 21.

Figure 4:
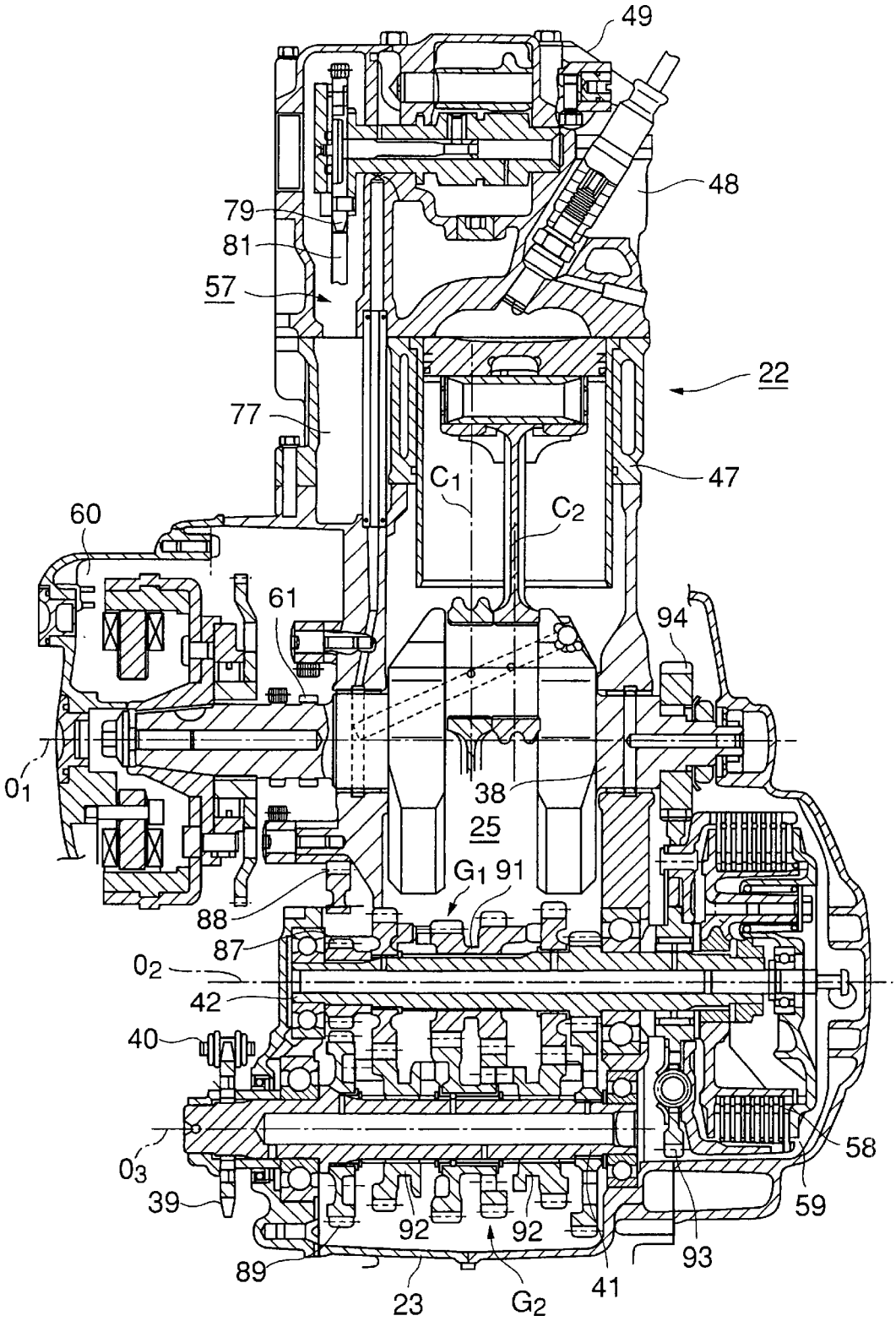
FIG. 4 is a development elevation of the section IV—IV shown in FIG. 2.

FIG. 4 is a sectional view of the section IV—IV shown in FIG. 2, showing the inside of the rear cylinder unit 22 and the mission chamber 24. In FIG. 4, the cylinder center line C2 of the rear cylinder unit 22 is shifted from the cylinder center line C1 of the front cylinder unit 21 to the right. On the left end side of the rear cylinder unit 22, the cam driving chain mechanism 57 for the rear cylinder unit 22 is arranged. Namely, a chain tunnel 77 for the rear cylinder unit 22 is formed in a left end wall of the rear cylinder unit 22. A cam sprocket 79 is installed at a left end of the cam shaft 52 for the rear cylinder unit 22. The cam chain 81 for the rear cylinder unit 22 is led into a generator chamber 60 via the chain tunnel 77 for the rear cylinder unit 22.

Outline of the Mission

As shown in FIGS. 3 and 4, the mission is of a gear continuously meshing type (constant-mesh type) and composed of forward 5 steps and backward one step. In the change gear input shaft 42, change gears of a change gear group G1 on input side for forward one step to forward 5 steps are fixed or loose fitted or spline-fitted with a shift sleeve 91 in a movable state in the axial direction and at the left end, a change gear 87 on the backward input side is fixed. A right end of the change gear input shaft 42 is projected into the clutch chamber 59 on the right, and a multi-plate clutch 58 is attached to the projected part, and a clutch gear 93 of the clutch 58 is meshed with a clutch gear 94 of the crank shaft 38. In the change gear output shaft 41, change gears of a change gear group G2 on the forward output side which continuously meshes with the change gear G1 on the forward input side are fixed or loose-fitted or spline-fitted with shift sleeves 92 in a movable state in the axial direction and at the left end, a change gear 89 on the backward output side is loose-fitted.

Figure 5:
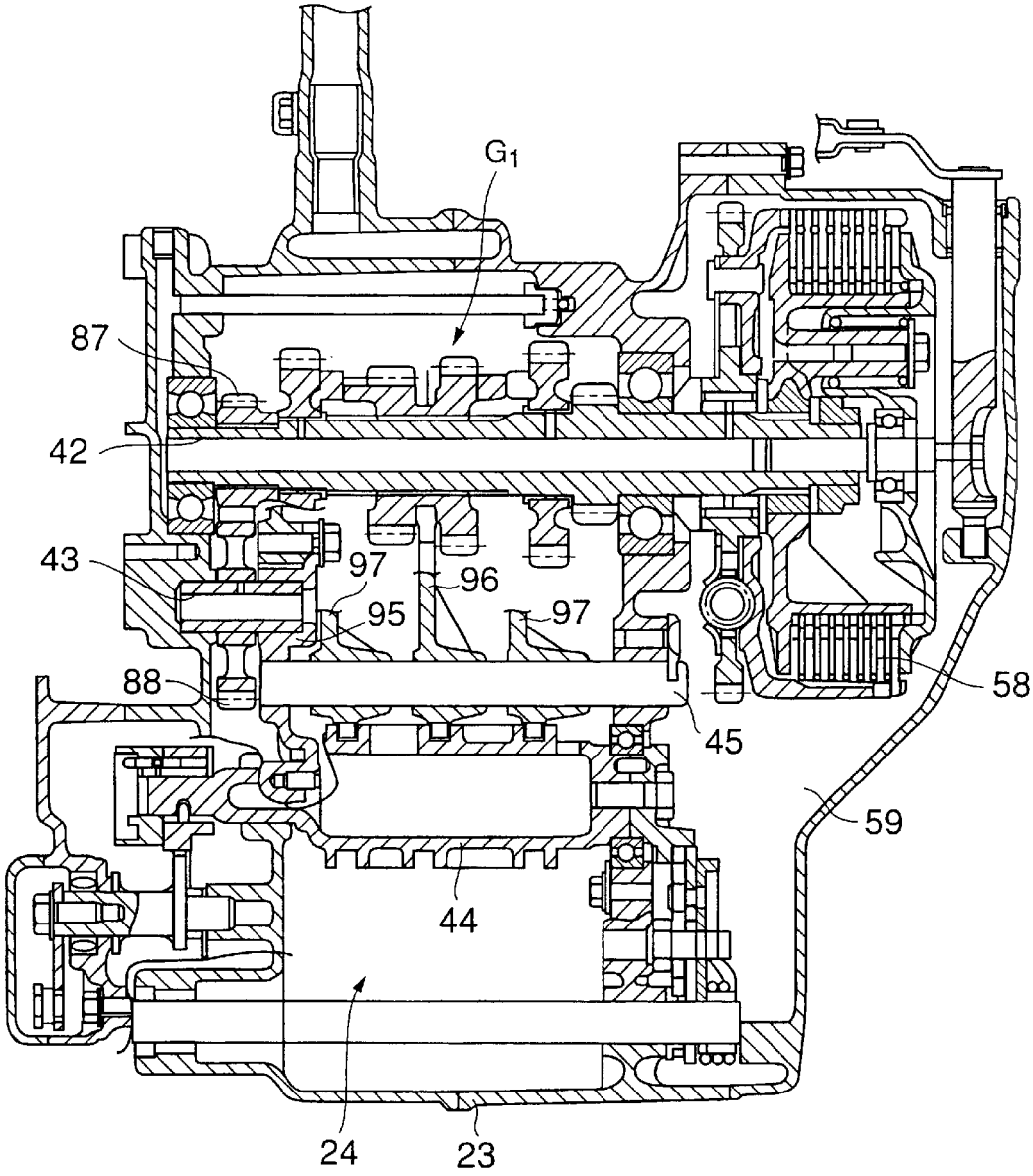
FIG. 5 is a development elevation of the section V—V shown in FIG. 2.

FIG. 5 is a development elevation of the section V—V shown in FIG. 2, and a backward idle shaft 43 is installed between a left end wall of the mission chamber 24 and a support member 95 fixed to the left end wall, and in the backward idle shaft 43, a backward idle gear 88 meshing with the change gear 87 and the change gear 89 on the backward side is fit.

In the shift rod 45, one shift arm 96 for the change gear input shaft and two shift arms 97 for the change gear output shaft are fit in a movable state in the shaft axis direction. Drive pins of the shift arms 96 and 97 are joined to a shift groove of the change drum 44. The shift arms 96 and 97 are moved in the shaft axis direction by the rotation operation of the change drum 44. The meshing between the change gear groups G1 and G2 is switched to a desired change gear step.

In FIG. 3, the rotation of the crank shaft 38 is transmitted to the change gear input shaft 42 via the crank gear 94, the clutch gear 93, and the multi-plate clutch 58, during the forward movement, transmitted to the change gear output shaft 41 via the change gears of the change gear groups G1 and G2 for forward movement connected to the desired change gear step, further during the backward movement, transmitted to the change gear output shaft 41 via the change gear 87 on the backward input side, the backward idle gear 88, and the change gear 89 on the backward output side, and transmitted to the rear axle 36 via the output sprocket 39, the rear wheel driving chain 40, and the sprocket 37 shown in FIG. 1.

In FIG. 2, the rotation (the arrow R1) of the crank shaft 38 is transmitted to the cam driving intermediate shaft 53 above the crank shaft via the intermediate chain mechanism 55 in the generator chamber 60, from the cam driving intermediate shaft 53, transmitted respectively to the cam shaft 51 for the front cylinder unit 21 and the cam shaft 52 for the rear cylinder unit 22 via the cam driving chain mechanism 56 for the front cylinder unit 21 and the cam driving chain mechanism 57 for the rear cylinder unit 22, and drives the cam mechanism for valve driving.

The present invention can be applied to an engine in which a fuel injection device is arranged above the V bank in place of the carburetor 33.

In the above-mentioned embodiment shown in the drawings, the cam driving chain mechanism 56 for the front cylinder unit 21 and the cam driving chain mechanism 57 for the rear cylinder unit 22 are distributed and arranged on both sides in the V-type engine. However, the present invention can be applied to a V-type engine in which the cam driving chain mechanism for the front cylinder unit and the cam driving chain mechanism for the rear cylinder unit are arranged on one side, i.e., left side or right side.

Tensioner is not limited to an automatic tensioner of an automatic feed device of a rack and ratchet pawl system and automatic tensioners of various automatic feed systems can be applied. Further, the transmission mechanism between the crank shaft and the cam driving intermediate shaft can be structured by a gear system in place of the chain system shown in the drawings.

Although the invention has been described in its preferred embodiment with a certain degree of particularity, obviously many changes and variations are possible therein. It is therefore to be understood that the present invention may be practiced otherwise than as specifically describe herein without departing from the scope and spirit thereof.

What is claimed is:

1. A V-type engine for vehicle comprising:

a front cylinder unit disposed in a forward slanting position, said front cylinder unit including a front cylinder, a front cylinder head for said front cylinder, and a front cam shaft arranged on said front cylinder head;

a rear cylinder unit disposed in a backward slanting position, said rear cylinder unit including a rear cylinder, a rear cylinder head for said rear cylinder, and a rear cam shaft arranged on said rear cylinder head;

a crank case with which a mission chamber is integrally formed at a back part of said crank case;

a crank shaft rotatably supported in said crank case;

a cam driving intermediate shaft arranged above said crank shaft;

a power transmitting mechanism interconnecting said cam driving intermediate shaft and said crank shaft;

cam driving chain mechanisms respectively interconnecting said cam driving intermediate shaft and each of said front and rear cam shafts;

a change gear input shaft to which a power from said crank shaft is input;

a change gear output shaft from which a power is output to an axle of said vehicle, said change gear output shaft being arranged in a back part in said mission chamber; and a tensioner for said cam driving chain mechanism for said rear cam shaft;

wherein said change gear input shaft and said tensioner are positioned within a range between a line connecting a shaft axis of said change gear output shaft and a shaft axis of said crank shaft and said rear cylinder unit.

2. The V-type engine for vehicle according to claim 1, further comprising a backward idle shaft arranged under said line connecting said shaft axis of said change gear output shaft and said shaft axis of said crank shaft.

3. The V-type engine for vehicle according to claim 1, further comprising a carburetor or a fuel jet device arranged above a V bank formed between said front cylinder unit and said rear cylinder unit.

4. The V-type engine for vehicle according to claim 2, further comprising a carburetor or a fuel jet device arranged above a V bank formed between said front cylinder unit and said rear cylinder unit.

5. The V-type engine for vehicle according to claim 1, wherein a center line of a V bank formed between said front cylinder unit and said rear cylinder unit is put into a slightly forward slanting position.

6. The V-type engine for vehicle according to claim 1, wherein said tensioner for said cam driving chain mechanism for said rear cam shaft is disposed on a rear wall of said rear cylinder.

* * * * *